United States Patent [19]

Herzog et al.

[11] 4,190,394

[45] Feb. 26, 1980

[54] METHOD FOR LOADING AND UNLOADING RAILROAD CARS

[75] Inventors: Stanley M. Herzog; Randy L. Poggemiller, both of St. Joseph, Mo.

[73] Assignee: Herzog Contracting Corporation, St. Joseph, Mo.

[21] Appl. No.: 901,230

[22] Filed: Apr. 28, 1978

[51] Int. Cl.[2] ..... B65G 67/00

[52] U.S. Cl. ..... 414/786; 414/339; 414/394; 414/503

[58] Field of Search ..... 414/333, 339, 394, 395, 414/503, 786

[56] References Cited

U.S. PATENT DOCUMENTS

| | | | |
|---|---|---|---|
| 1,263,170 | 4/1918 | Webb | 414/394 X |
| 1,361,832 | 12/1920 | Crilly | 414/394 X |
| 1,678,245 | 7/1928 | Dickinson et al. | 414/339 X |
| 2,801,014 | 7/1957 | Colson | 414/503 |
| 3,107,803 | 10/1963 | Glosup | 214/520 |
| 3,329,289 | 7/1967 | Fritz | 214/44 |
| 3,376,988 | 4/1968 | Klosk | 214/515 |
| 3,881,612 | 5/1975 | Wells | 414/394 |
| 4,096,954 | 6/1978 | Buckner | 214/38 CC |
| 4,099,635 | 7/1978 | Leonard et al. | 214/152 |
| 4,128,180 | 12/1978 | Mellious | 414/339 |

*Primary Examiner*—Stephen G. Kunin
*Assistant Examiner*—Terrance L. Siemens
*Attorney, Agent, or Firm*—Fishburn, Gold & Litman

[57] ABSTRACT

A method of loading and unloading an open top or gondola railroad car utilizes a mobile, wheeled apparatus having power actuated front and rear boom structures. A front supportive foot engageable with the upper surfaces of the railroad car sidewalls is connected to free ends of the front boom structure and similarly engageable rear supportive feet are connected to the ends of outrigger arms movable outwardly from the sides of the rear end of the mobile apparatus. The rear boom structure includes an articulated material engaging grapple for loading and unloading operations. During operation, the operator positions the mobile apparatus adjacent an end of the railroad car with the front boom raised and the front supportive foot engaged with the top surfaces of the car sidewalls. The rear boom and material engaging grapple is folded close to the apparatus rear end and by coordinately operating the front and rear boom structures and the material grapple, the mobile apparatus is raised above the railroad car walls and moved forwardly until the front and rear supportive feet engage with the side wall upper surfaces. Then, the rear boom and material handling grapple is used to load and unload materials relative to the railroad car. Transfer from one railroad car to another in a train thereof is also accomplished by coordinated use of the front and rear boom structures.

12 Claims, 11 Drawing Figures

METHOD FOR LOADING AND UNLOADING RAILROAD CARS

This invention relates to a method for handling materials and particularly to a method for loading and unloading open top railroad cars. Unloading operations have been accomplished by mobile cranes and the like positioned along a track outside of the railroad car track. However the unloading operations may be along a track far from a depot, yard or other facility where cranes may be used for such unloading operations and any equipment used must be transported to such a site. Therefore, the handling of materials such as crossties and railbed ballast has heretofore been accomplished either by manual labor or by the use of methods employing relatively expensive and complex devices specifically designed for such use. The use of hand labor is, of course, normally costly and is inordinately time-consuming. Alternatively, a specifically designed material handling apparatus quite often requires a considerable capital expenditure which ties funds to equipment having a relatively limited purpose and without reasonable possibilities of adaption for other construction requirements and material handling uses.

The present invention overcomes the above deficiencies and provides a method utilizing a material handling mobile apparatus for unloading and loading open top, or gondola railroad cars in a relatively quick and efficient manner and which needs no ramps, cranes, or the like to position itself on top of the cars for material handling operations. Rather, the apparatus includes brackets or feet for supportive engagement with upper surface the car sidewalls and, using the method described below, is able to climb atop the car sidewalls from a position on the ground adjacent an end of the car. A conventional and relatively low cost mobile apparatus is employed which is quickly and easily converted from a normal use configuration to a railroad car engaging configuration for loading and unloading operations.

Such a relatively conventional structure provides the advantages of requiring a significantly low capital investment as well as permitting required types of equipment to be kept to a minimum. For example, where construction and material handling is to be conducted at a remote site, only a few items of equipment, including the apparatus used with the present method need be transported to the site. After the use of the same to unload railroad cars containing, for example, crossties and ballast for rail bed construction, the means for engagement with the car side walls may be easily removed and conventional members connected thereto, thereby converting the apparatus for normal digging, trenching, and ground material handling operations.

In view of the above, the principal objects of the present invention are: to provide method for loading and unloading an open top container structure such as a railroad gondola car; to provide such a method employing an apparatus having support members for engagement with the upper surfaces of the spaced, parallel side walls of a gondola car; to provide such a method employing an apparatus similar in configuration to a tractor having a loader arm and digging bucket on the front end thereof and an articulated boom with a back-hoe bucket, clam shell digger, grappling members or other material handling and lifting devices on the rear end thereof; to provide such a method employing an apparatus including an articulated boom structure having a selected material handling device connected thereto; to provide such a method for positioning an apparatus on the ground adjacent a railroad car and climbing from the ground to atop the sidewalls of the car; to provide such a method utilizing an apparatus which is readily convertible to a conventional material handling apparatus for extensive ground operations; to provide such a method which is suitable for a multitude of material handling and construction operations; to provide such a method employing an apparatus having power actuated front and rear boom structures of such respective lengths to reach below the ground surface and above the railroad car side and end walls when positioned on the ground therealong; to provide such a method employing an apparatus having a rear boom structure which can be swung from one side to another of the railroad car to accomplish loading and unloading operations; to provide such a method employing an apparatus having means moving the apparatus longitudinally along the side walls of the railroad car while accomplishing material loading and unloading operations; and to provide such a method which is economical to perform, safe to employ, efficient in operation, and highly effective for its intended purpose.

Other objects and advantages of this invention will become apparent from the following description taken in connection with the accompanying drawings wherein are set forth by way of illustration and example, a certain embodiment of this invention.

Figure 1:
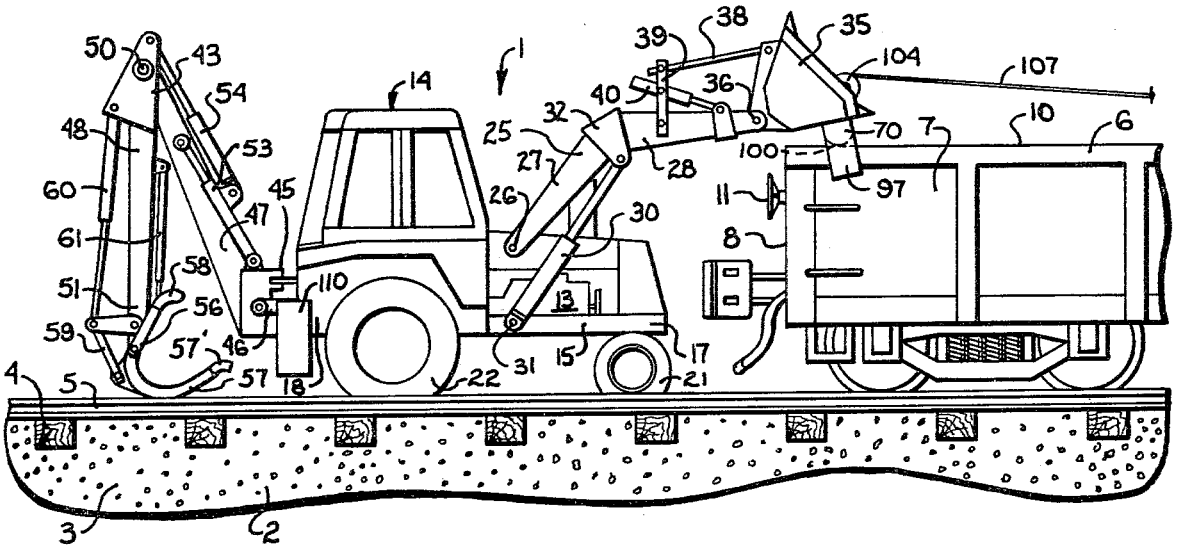
FIG. 1 is a side elevational view illustrating a mobile apparatus employed in this method and which is positioned adjacent to a railroad car.

Referring more in detail to the drawings:

As required, a detailed embodiment of the present invention is disclosed herein, however, it is to be understood that the disclosed embodiment is merely exemplary of the invention which may be embodied in various forms. Therefore, specific method steps disclosed herein are not to be interpreted as limiting, but merely as a basis for the claims and as a representative basis for teaching one skilled in the art to variously employ the present invention in connection with virtually any appropriately detailed structure.

The drawings are particularly related to a method employing an apparatus which is adapted for unloading gondola type railroad cars. It will become apparent from the following description that the method and apparatus are capable of use with any appropriately configured open container, not only including gondola cars but also elongate open tanks, flat flat bed cars, and the like.

In general overview, the apparatus is mobile and includes a wheel supported frame having an arm or boom pivotally mounted at one end for up and down swinging movement, a support or foot member pivotally mounted on a free end of the boom for engaging the upper surface of the side walls of an open railroad car and retaining the apparatus front end thereon and power means operably connected to the arm and foot members for selectively moving same relative to the frame. The frame has an articulated boom mounted at the rear end for up and down and side to side swinging movement and has a free end having a material engaging device pivotally connected thereto. Outrigger arms are pivotally mounted to the frame sides adjacent the rear end thereof and have feet for engaging the upper surface of the side walls and retaining the apparatus rear end thereon. An operator's seat is mounted on the frame in proximity to controls whereby the operator may selectively effect movement of the front boom, front supportive foot, rear articulated boom and material engaging device, outrigger arms and rear supportive feet and to move the apparatus and position same.

More in detail, the reference numeral 1 indicates generally one type of apparatus used in the practice of this method for unloading and loading container cars. The apparatus includes a combination back-hoe tractor which, prior to configuration thereof as described below, is of the type commonly used in construction and material handling operations and is depicted positioned on a railroad bed 2 comprised of a built-up base of gravel or ballast 3 over which crossties 4 are laid. Rails 5 are mounted on the crossties 4, thereby forming a section of railroad track. The apparatus 1 is used for loading and unloading an elongate gondola car 6 which, as is conventional, includes spaced, parallel, upright side walls 7 joined to opposite end walls 8 and 9 and having spaced, parallel upper surfaces 10 extending therearound. A handle 11 is operably connected to the brakes of the gondola car 6 which prevent undesired and inadvertent rolling thereof, such as during positioning of the apparatus 1 atop the side walls 7 of the car 6.

The apparatus 1 includes an engine or other power device generally at 13, an operator's cab 14 having a seat and suitable power and operating controls therein and a frame 15 having opposite front and rear ends 17 and 18. The apparatus 1 is wheel mounted, and includes front and rear pneumatic tires 21 and 22 connected to axles (not shown) attached to the frame 15 for providing movement over the ground surface. A pair of front boom arms 25 are mounted at pivot points 26 to front end portions of the apparatus 1 for up and down swinging movement and include respective joined pairs of arm sections 27 and 28. The front boom arms 25 are of such a length to reach below the ground surface and above the railroad car side and end walls 7, 8 and 9 when the apparatus 1 is positioned on the ground. Movement is provided by motive means, such as hydraulic cylinders 30 having one end thereof connected to a joint 32 interconnecting the arm sections 27 and 28 and having the other end thereof connected to a pivot 31 on the frame 15 and spaced from the boom pivot 26 for the up and down swinging action thereof.

In the illustrated example, the arm sections 28 have respective free ends 34 connected to a selected earth engaging and material handling device or tool, such as a bucket 35 or the like. The bucket 35 is hingedly connected to the free ends 34 by pins 36 permitting limited forward and rearward tilting movement and is controlled for rotational movement by respective linkage arms 38 pivotally connected to each other and forming a parallelogram-shaped structure in coordination with the arm sections 28 and the bucket 35. Side arms 39 are pivotally connected to second hydraulic cylinders 40 which are also connected to portions of the arm sections 28 spaced from the side arms 39 for effecting movement thereof and movement of the bucket 35 by drawing the same forwardly and rearwardly. The cylinders 30 and 40 are connected by suitable conduits and hoses to hydraulic power means which are associated with the engine 13 and which are controlled by suitable means located in the operator's cab 14.

An articulated, rear boom structure 43 is connected to the rear end 18 and is pivotally movable from side to side and movable for up and down swinging movement relative to the frame 15. As used herein, the phrase "rear boom structure" includes not only a boom connected to the rear end portions of the apparatus 1 but also a boom connected to other portions of the apparatus 1 and which is movable into a rearwardly extending position.

In the illustrated example, the rear boom structure 43 has vertically spaced ear members connected to coordinating vertically spaced ear members on the rear end 18 at upper and lower pivot points 45 for horizontal swinging motion. Suitable power means for effecting rotation, such as a hydraulic ram or rotary motor 46 is operably connected thereto. The rear boom structure 43 is connected thusly to the frame rear end 18 and has a pair of arm sections 47 and 48 foldable relative to each other and interconnected at a joint 50. The arm section 48 includes a free end 51. The arm sections 47 and 48 are of a combined length to reach the ground when the mobile apparatus 1 is positioned atop the side walls 7 of the railroad car and to reach above the same when the mobile apparatus 1 is positioned on the ground adjacent the railroad car. A hydraulic cylinder 53 is pivotally connected to the arm section 47 for folding the same relative to the apparatus end 18. Additionally, a hydraulic cylinder 54 pivotally connecting a portion of the joint 50 and the arm 47 permits folding of the arm section 48 relative to the arm section 47.

The free end 51 of the arm section 48 is capable of accepting a selected material engaging and/or earth engaging device or tool such as a bucket, clamshell digger and the like, and in the illustrated example, a material grapple 56 is connected thereto. The exemplary grapple 56 has curved claws 57 with ends or tips 57' and an opposing thumb structure 58 connected to a hydraulic cylinder 61 also connected to the arm section 48 and is operable to grasp and lift objects, such as the crossties 4. Accordingly, linkage arms 59 are pivotally connected to the claws 57 and are actuated by a hydraulic cylinder 60 connecting the joint 50 and the linkage arms 59. Together, the linkage arms 59 and the hydraulic cylinder 60 cooperate to longitudinally pivot the grapple 56 between a curled under position extended toward the apparatus rear end 18, and an extended position reaching away from the rear end 18. Here too, the hydraulic cylinders 53, 54, 60 and 61 are connected by suitable hose means (not shown) to a hydraulic power means associated with the engine 13.

Figure 5:
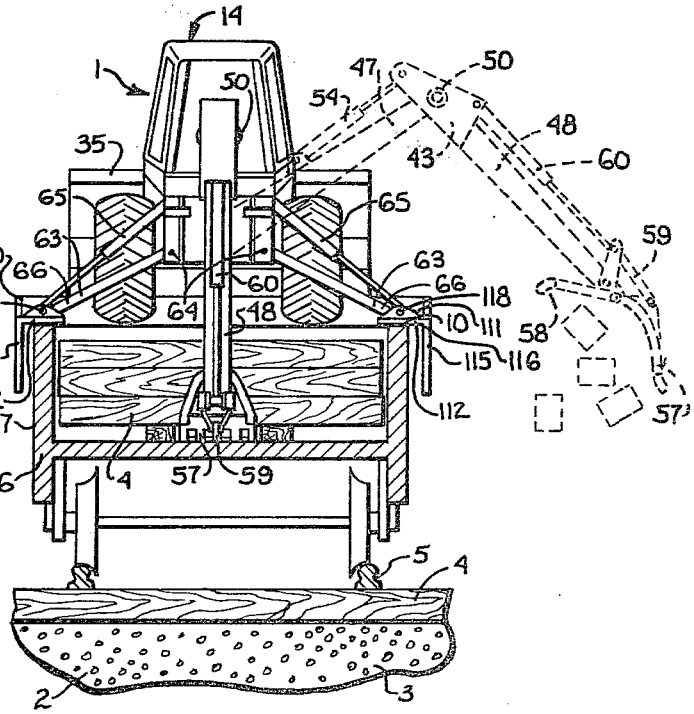
FIG. 5 is a cross-sectional view of the front of the apparatus upon the railroad car and performing unloading operations and illustrating rear support feet thereof.
Figure 6:
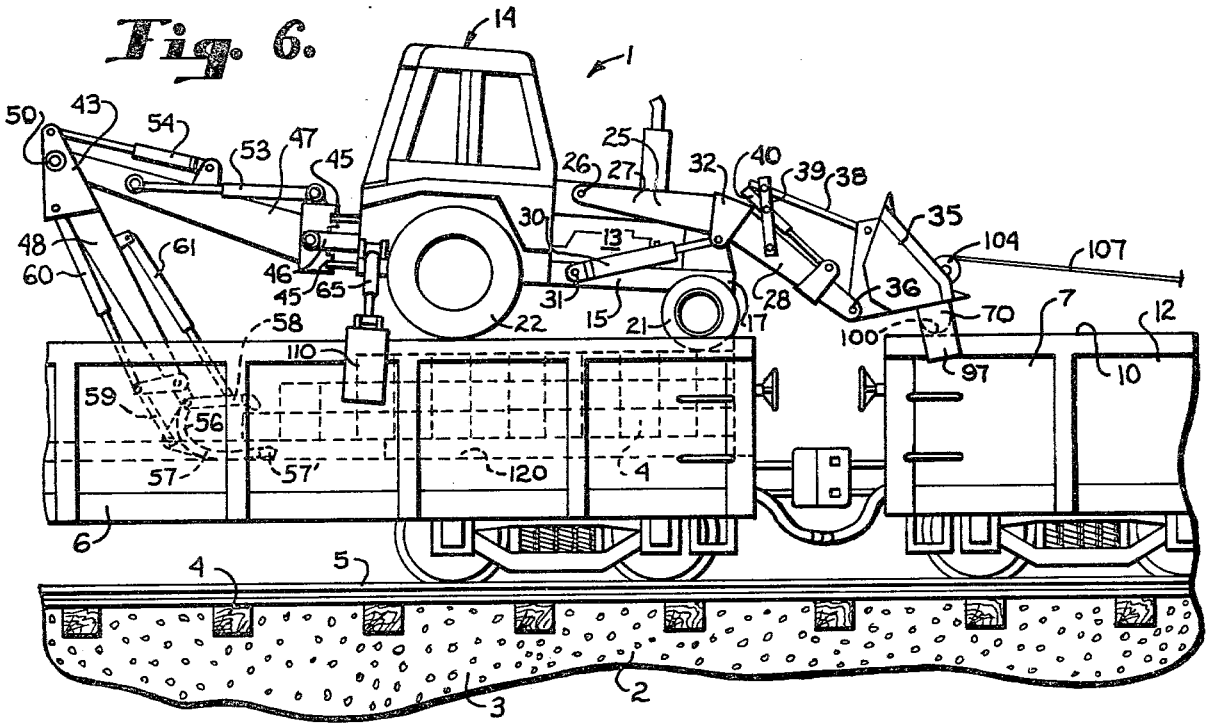
FIG. 6 is a side elevational view similar to FIG. 3 and showing the apparatus in transfer sequence between a first car and a second car.
Figure 7:
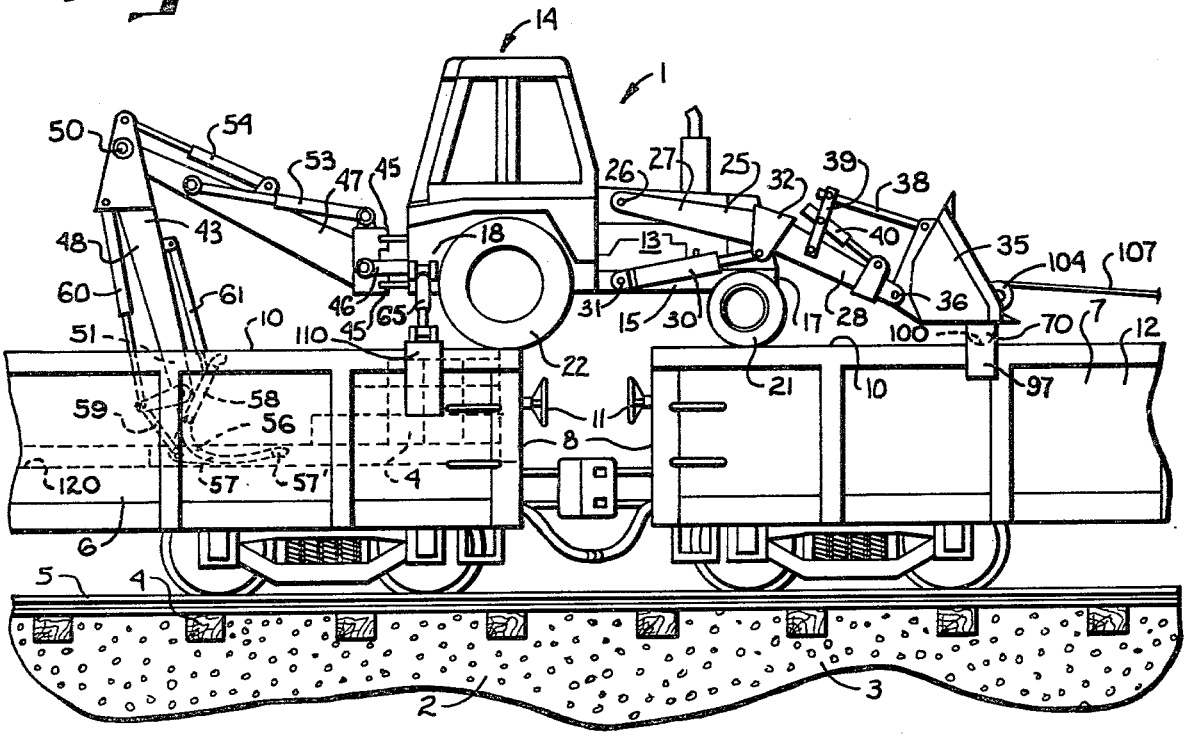
FIG. 7 is a side elevational view similar to FIG. 6 and showing the apparatus in car transfer sequence.
Figure 8:
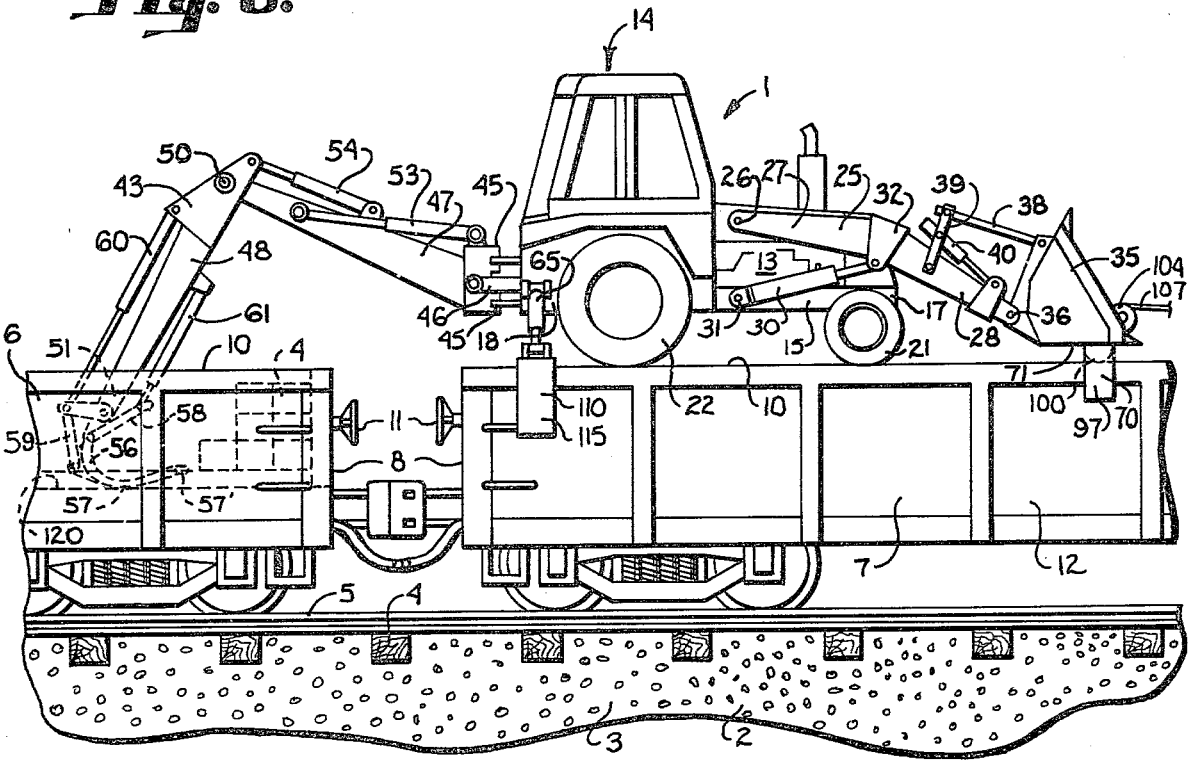
FIG. 8 is a side elevational view similar to FIG. 6 and illustrating the apparatus atop a second railroad car and having front and rear support brackets thereof engaging the upper surfaces of the side walls of the railroad car.
Figure 9:
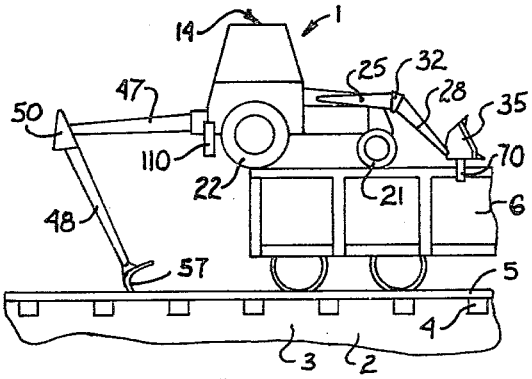
FIG. 9 is a diagrammatic side elevational view illustrating the mobile apparatus positioning itself upon the upper surfaces of the sidewalls of a railroad car.
Figure 10:
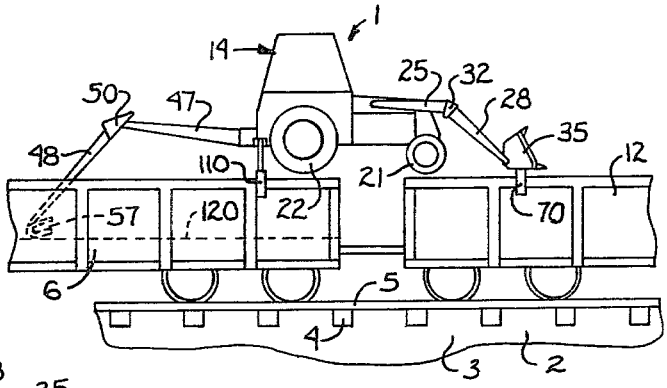
FIG. 10 is a diagrammatic side elevational view of the apparatus in a car transfer sequence and between a first and a second car.
Figure 11:
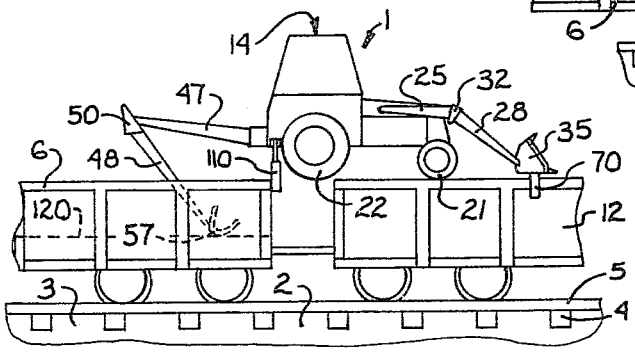
FIG. 11 is a diagrammatic side elevational view in progression with FIGS. 8 and 9 and showing the apparatus in a car transfer sequence and between a first and a second car.

The mobile apparatus 1 further includes a pair of power actuated foldable outrigger arms 63, FIG. 5, connected for up and down, or inward and outward, swinging movement at pivots 64 to the frame sides adjacent the rear end 18 and operated by respective hydraulic cylinders 65 extending between arm free ends 66 and the frame 15.

Figure 4:
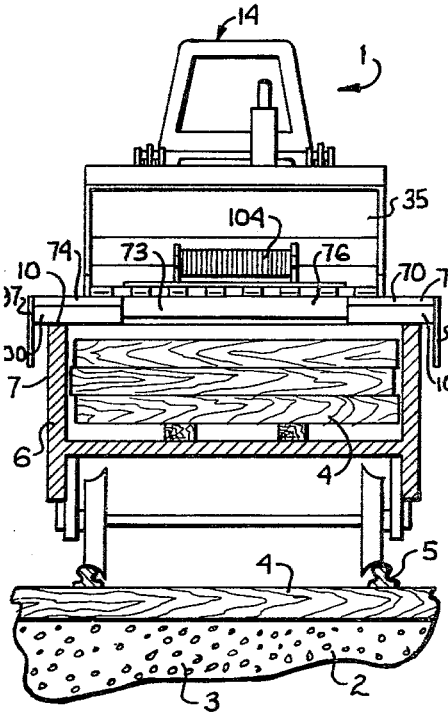
FIG. 4 is a cross-sectional view of the front of the apparatus engaged upon the upper surface of the side walls of the railroad car and illustrating a front support foot thereof.

For positioning the mobile apparatus 1 atop the gondola car 6, front and rear mounting means adapted for engagement with the upper surfaces 10 of the spaced, parallel, side walls 7 thereof are attached to respective portions of the mobile apparatus 1. As best illustrated in FIG. 4, a front supporting bracket or foot 70 is mounted parallely to the bottom 71 of the bucket 35. The front supportive foot 70 includes an elongate beam 73, such as an H beam, having opposite ends 74 and 75 and a pair of spaced parallel flanges 76 connected by a web (not shown) extended normally therebetween. The beam 73 is of greater length than the bucket 35 and the ends 74 and 75 extend beyond the bucket margins a sufficient distance to project transversely across the upper surfaces 10 of the railroad car side walls 7.

To limit lateral sliding of the front support bracket 70 when the mobile apparatus 1 is positioned atop the gondola car 6, downwardly extending, elongate, planar arms 97 and 98 are normally connected to the ends 74 and 75 of the beam 73. To promote longitudinal sliding of the front supportive foot 70 along the upper surfaces 10, as described below in connection with the operation of the apparatus 1, rounded bottom members 100 and 101, such as of longitudinally halved pipe sections, are affixed to the bottom of the beam 73 adjacent the ends 74 and 75 and facilitate rolling thereof during tilting of the bucket 35 and for slidingly engaging the upper surfaces 10.

Preferably, a winch means is connected to the apparatus 1 and is operable to longitudinally draw the same along the upper surfaces 10 of the side walls 7 when the apparatus 1 is positioned thereon. This may be a portable winch having the winch body thereof positioned remotely from the apparatus 1 or can be, as in the illustrated example, a revolving reel-type winch 104 mounted within the interior of the bucket 35. In the present example, the winch 104 is secured to the top surface of the bucket bottom 71. The winch 104 contains a quantity of cable or line 107 having a free end (not shown) capable of attachment to a point longitudinally aligned with the mobile apparatus 1 and remotely positioned therefrom.

Rear supportive feet 110 and 111 engage the upper surfaces 10 of the railroad car side walls 7 when the mobile apparatus 1 is positioned atop the railroad car. In the illustrated example, the rear supportive feet 110 and 111 respectively include side wall upper surface engaging planar pad members 112 pivotally connected by pins 118 to free ends 66 of each outrigger arm 63 for limited swinging movement toward and away from the frame 15. The respective pads 112 have upturned ends (not shown) facilitating forward sliding of the rear support brackets 110 and 111 on the car rails 10. Downwardly extending arms 115 are normally connected to pad edges 116 and engage the walls of the sidewalls 7 to limit lateral movement of the pads 112 when the rear supportive feet 110 and 111 are engaged with the upper surfaces 10.

As described above, the front supportive foot 70 and the rear supportive feet 110 and 111 provide engagement means for removably positioning the apparatus 1 atop the side wall upper surfaces 10 and then using the rear boom structure 43 for loading and unloading the gondola car 6. To position the mobile apparatus 1 thusly, the operator seated within the cab 14 drives the apparatus 1 onto the railroad bed 2 and into longitudinal, end-to-end position with gondola car 6. The driver raises the front boom arms 25 and tilts the bucket 35 forwardly. Then the driver positions the apparatus 1 sufficiently close to the car end 8 so that the front boom arms 25 extend thereover, FIG. 1.

Line 107 may be withdrawn at this time from the winch 104 and the free end thereof attached to a suitable anchoring point longitudinally and remotely spaced from the car end 8, although the use of the winch 104 is not required for the operation of the invention and the line 107, if desired, may be extended and anchored after the apparatus 1 is positioned on the side walls 7. Such an anchor may include the opposite car end 9 or, if the car 6 is the near end car of a train of cars, may include suitable anchors on other cars.

Next, the operator positions the rear boom structure 43 in longitudinal alignment with the apparatus 1 and rearward of the rear end 18. The rear boom structure 43 is folded as much as possible and the grapple 56 curled under and toward the apparatus 1 until the grapple 56 is positioned adjacent the rear end 18. The rear boom arm 43 is then lowered until the outside surface of the material handling device, such as the curved grapple claws 54, engages the ground of the railroad bed 2 adjacent the rear end 18, FIG. 1, and thereby transfers upward and lifting force to the rear end 18. The operator coordinately tilts the bucket 35 forward and lowers the front boom arms 25 until the ends 74 and 75 of the front supportive feet 70 engage and rest upon upper surfaces 10 of the parallel 7 and exert upward lifting force on the apparatus front end 17.

It will be apparent that in operation, as illustrated in FIG. 1, the apparatus 1 is braced against the top of the gondola car 7 at its front end 17 and against the ground at its rear end 18, the rear boom structure 43 being folded and the front boom arms 25 being raised. Next, in preparation for positioning the apparatus 1 atop the car side walls 7, the operator swings the outrigger arms 63 outwardly until the rear supportive feet 110 and 111 are appropriately spaced for the distance between the spaced side walls 7 for engagement thereon. To elevate the apparatus 1, the operator actuates the appropriate power controls to lower the front boom arms 25, pressing downwardly on the car side walls 7, and to simultaneously unfold the rear boom arm 43, pressing against the ground, and thereby raising the apparatus 1 without aid from platforms, ramps, external lifting devices, and the like.

Figure 2:
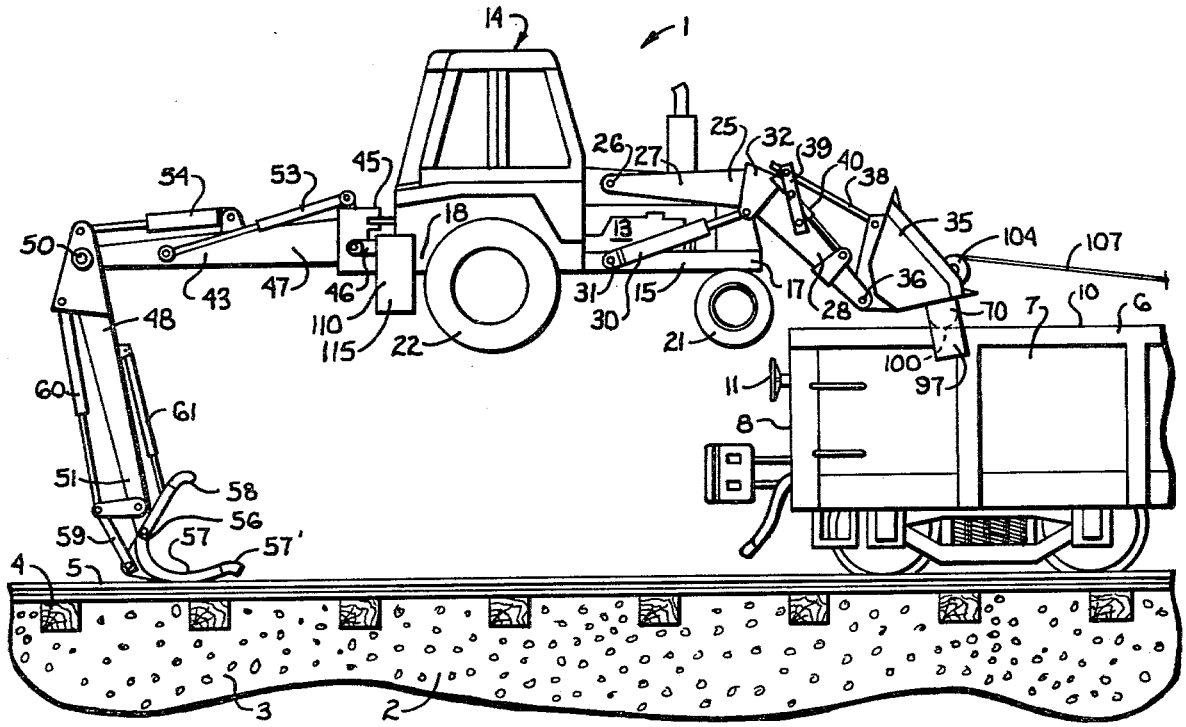
FIG. 2 is a side elevational view similar to FIG. 1 and showing the apparatus elevating itself above the railroad bed.
Figure 3:
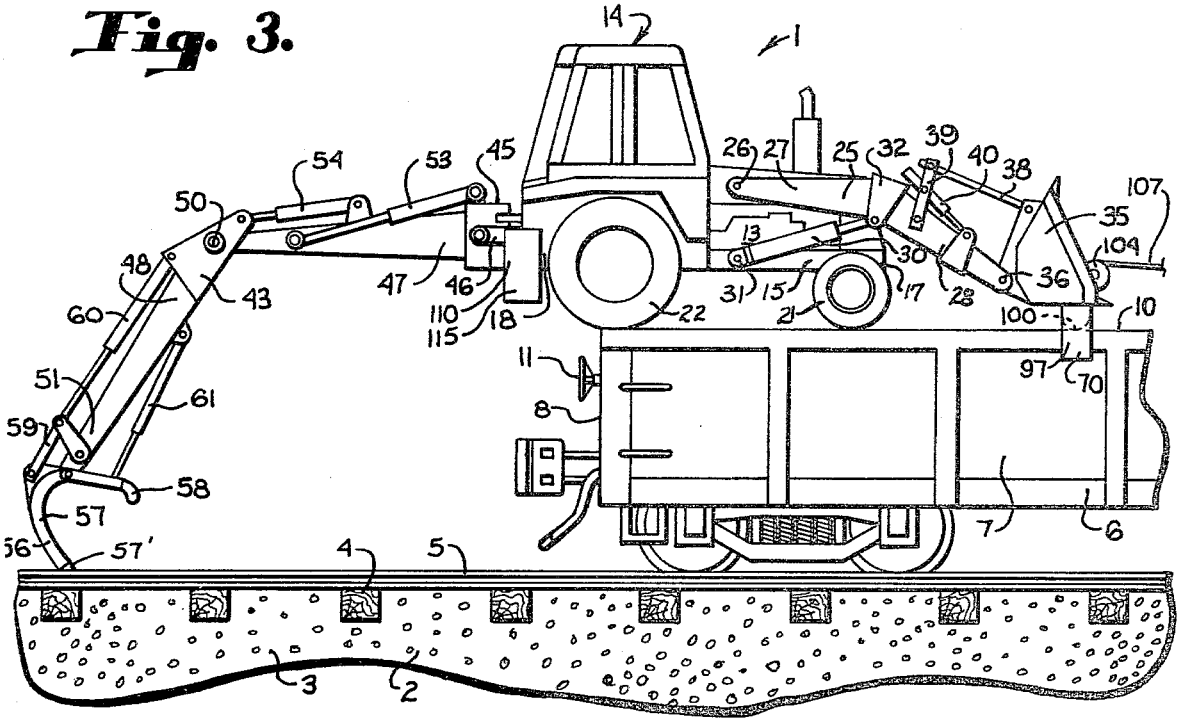
FIG. 3 is a side elevational view similar to FIG. 2 and illustrating the apparatus partly in position atop the upper surfaces of the sidewalls of a railroad car.

As best shown in FIG. 2, the operator raises the apparatus 1 to an elevation preferably slightly above and at least level with the upper surfaces 10 so that the apparatus 1 can be moved forwardly and positioned atop the side walls 7. By manipulation of the hydraulic cylinder controls to the rear boom structure 43 and through coordinated use of the winch 104, if desired, to draw the line 107 inwardly the operator further unfolds the rear boom structure 43 moves the apparatus 1 toward the car end wall 8. Concurrently, the operator rotates the bucket 35 rearwardly on the curved bottom members 100 and 101 and, in the illustrated example, fully raises the grapple 56 forwardly onto the claw tips 57', FIG. 3, to move the apparatus 1 forwardly until the rear tires 22 slide over the end wall 8.

Depending on the starting distance between the apparatus 1 and end wall 8, the initial bite or position of the rear boom arm 43 may be sufficient so that, once the rear boom structure 43 and the grapple 5 is fully extended rearwardly, the rear support feet 110 and 111 engage the end of the side walls 7 and support the apparatus 1 thereon. However, should the initial positioning of the apparatus 1 on the ground not be sufficiently close to the end wall 8 and the rear tires only extend slightly past the end wall 8 and engage same to support the apparatus 1, the rear boom structure 43 is then partly folded and retracted, and repositioned engaging the ground close to the end wall 8. The rear boom structure 43 is again unfolded to lift the rear end 18 and move the front support foot 70 forwardly along the upper surface 10 until the rear supportive feet 110 and 111 engage the spaced upper surfaces 10 and thereby support the apparatus 1 on the side walls 7. Adjustment of the outrigger arms 63 outwardly or inwardly is then accomplished to engage the lateral movement limiting arms 115 with the side walls 7.

Once the apparatus 1 is atop the gondola car 6, movement along the upper surfaces 10 of the side walls 7 is accomplished by alternately folding the rear boom structure 43 and engaging the car bottom surface 120 adjacent the rear end 18 and then unfolding the same to slide the front and rear supportive feet 70, 110 and 111 along the upper surfaces. Alternatively, the apparatus 1 can be moved by actuating the winch 104 to draw the line 107 inwardly and thereby pull the apparatus 1 along the upper surfaces 10.

Once atop the gondola car 6, the rear boom structure 43 is used to load or unload materials relative to the car 6. For example, crossties 4 contained within the car 6 are grasped by use of the grapple 56 and deposited along the railroad bed 2 adjacent the gondola car 6 as desired. Alternatively, materials positioned beside the railroad bed 2 and within range of the rear boom structure 43 can be lifted into the gondola car 6 and discharged thereinto during loading operations.

Handling materials as described above, the apparatus 1 is moved the length of the gondola car 6 until the opposite end wall 9 is reached. The apparatus 1 is capable of moving itself from one car 6 into an adjoining car 12 in a train thereof. To accomplish this, the operator moves the apparatus 1 as close to the end wall 9 as possible. The operator then raises the front boom arms 25, thus lowering the front tires 21 until the same rest upon a supportive surface comprising, in the illustrated example, materials contained within the car 6, such as crossties 4. If the car interior adjacent the end wall 9 is empty, sufficient materials should be previously placed therein to support the front tires 21. The bucket 35 is raised and the apparatus moved forwardly in the car until the front boom arms 25 and the front supportive foot 70 extend over the front end wall 8 of the adjoining gondola car 12. The bucket 35 is tilted forwardly in preparation for engagement with the side wall upper surfaces 10 of the adjacent gondola car 12.

The front boom arms 25 are lowered and the front supportive foot engaged with the upper surfaces 10 of the side walls 7 adjacent the end wall 8 of the adjoining gondola car 12. The rear boom structure 43 is folded forwardly as previously described and the grapple 56 engaged with the car bottom surface 120 in preparation for moving the apparatus forwardly. Further downward movement of the front boom arms 25 and rotation of the bucket 35 rearwardly elevates the apparatus 1 above the side walls 7 and moves the apparatus 1 forwardly. Simultaneously, the rear boom structure 43 is unfolded to lift the rear end 18 of the apparatus 1 and move the same forwardly and into position spanning the respective end walls 9 and 8 of the two gondola cars 6 and 12.

The operator continues loading and unloading operations, moving the apparatus 1 along the respective car rails 10 of the end-to-end gondola cars 6 and 12 until the rear supportive feet 110 and 111 reach the end wall 9 of the gondola car 6. Then, the rear boom structure 43 is folded and positioned on the car bottom surface 120 so that the grapple 56 is adjacent and aligned with the apparatus rear end 18. The rear boom structure 43 is unfolded to simultaneously lift the rear end 18 and disengage the rear supportive feet 110 and 111 from the side walls 7 of the first gondola car 6 and lift the rear end 18 over the separation between the end-to-end gondola cars 6 and 12 until the rear supportive feet 110 and 111 are shifted over the first end wall 8 of the second gondola car 12. The rear boom structure 43 is then raised to lower the apparatus 1 until the rear support feet 110 and 111 engage the upper surfaces 10 of the second car side walls 7, thereby transferring the apparatus 1 from one gondola car to another. For an operator familiar with the above procedures, this is a relatively simple maneuver and can be accomplished quickly, even while the train is slowly moving.

To remove the apparatus 1 from atop the gondola car, the direction of movement of the apparatus 1 is reversed and the same moved rearwardly by alternately unfolding the rear boom arm 43, engaging the bottom 120 of the gondola car 6 and then folding the same to pull the apparatus 1 rearwardly. The apparatus 1 is shifted from car to car if necessary, reversing the transfer procedure described above, until the end 8 of the last car is reached, that is: the starting point where the apparatus 1 climbed atop the car 6. The operator of the apparatus 1 then reverses the above described upward climbing procedure to remove the apparatus 1 from atop the car 6.

First, the rear boom structure 43 is unfolded and the grapple 56 engaged with the ground longitudinally adjacent the car end wall 8. The boom structure 43 is partially folded and the front boom arms 25 lowered to disengage the front and rear supportive feet 70, 110 and 111 from the sidewall upper surfaces 10 and remove the apparatus 1 from atop the car 6. The apparatus 1 is then lowered to the ground by further folding the rear boom structure 43 and raising the front boom arms 25.

It is to be understood that while one form of this invention has been illustrated and described, the present method is not to be limited to the specific form or arrangement of parts and apparatus used to employ same, except insofar as such limitations are included in the following claims.

What we claim and desire to secure by Letters Patent is:

1. A method of loading and unloading an open top railroad car comprising:

(a) providing a mobile powered apparatus having front and rear wheels movable over ground surface and including power actuated boom structures pivotally mounted at respective front and rear ends of said mobile apparatus wherein the front boom structure is of a length to reach below the ground surface and above the railroad car upper surface when the mobile apparatus is positioned on the ground and has a free end with a supportive foot member connected thereto and wherein the rear boom structure is articulated and of a combined length to reach the ground when said mobile apparatus is positioned on said car upper surface and said boom structure has respective arm lengths with a material engaging device pivotally mounted on a free end thereof and cooperative therewith, and a rear end of the mobile apparatus including outwardly swingable power actuated outrigger arms with respective supportive foot members connected thereto;

(b) moving said mobile apparatus over the ground surface and positioning same adjacent one end of an open top railroad car;

(c) raising said front boom structure (d) engaging the front boom structure foot member with the upper surface of said railroad car;

(e) folding said rear boom structure; and (f) engaging said material engaging device upon the ground surface longitudinally aligned with and adjacent the apparatus rear end;

(g) coordinatingly operating said front and rear boom structures and unfolding said rear boom structures in engagement with the ground surface while pressing downwardly with said front boom structure and said front supportive foot upon the railroad car upper surface to raise the mobile apparatus from the ground surface and above the upper surface of said railroad car and support said apparatus front end on the railroad car surface of said railroad front supportive foot with same;

(h) further unfolding said rear boom structure in engagement with the ground surface and moving said mobile apparatus forwardly toward said railroad car and supporting said apparatus rear end on the upper surface thereof by engaging the outrigger arms supportive foot members on the railroad car upper surface;

(i) moving said mobile apparatus along the upper surface of said railroad car; and (j) operating said articulated rear boom structure and material engaging device to engage and disengage material relative to said railroad car and swing same to the ground surface alongside said railroad car.

2. The method set forth in claim 1 including:

(a) spaced, parallel side walls extending around said railroad car and having said upper surface thereon; and (b) swinging said outrigger arms outwardly to engage the supportive foot members thereof upon the upper surface of said side walls after said mobile apparatus is moved forwardly onto said railroad car to support the mobile apparatus rear end thereon.

3. The method set forth in claim 2 including:

(a) preventing lateral movement of said mobile apparatus upon the railroad car upper surface by positioning lateral movement limiting members on said outrigger arms supportive feet members and engaging the side walls of said railroad car for limiting relative lateral movement.

4. The method set forth in claim 1 including:

(a) folding said material engaging device relative to said rear boom structure and rotating said material engaging device toward the mobile apparatus rear end prior to engaging said material engaging device upon the ground surface longitudinally aligned with and adjacent the mobile apparatus rear end; and (b) unfolding said material engaging device in engagement with the ground surface and rotating said material engaging device away from said mobile apparatus rear end when said mobile apparatus is raised and moving the mobile apparatus forwardly onto said railroad car.

5. The method set forth in claim 1 wherein the front boom structure supportive foot member is connected to said front boom structure free end by power actuated means permitting forward and rearward rotating movement and the supportive foot member includes rounded surfaces for rolling and sliding engagement with the railroad car upper surface, the method including:

(a) rotating said front boom structure supportive foot member forwardly and engaging said front boom structure supportive foot member with the upper surface of said railroad car; and (b) rotating said front boom structure supportive foot member rearwardly and rolling said front boom structure supportive foot member forwardly on said upper surface when moving said mobile apparatus forwardly toward said railroad car after raising same from the ground surface and thereby drawing said mobile apparatus forwardly.

6. The method set forth in claim 1 wherein the railroad car has a pair of spaced, parallel side walls and respective end walls and the side walls have upper surfaces extending therearound, and wherein the outrigger arms supportive foot members and said front boom structure supportive foot members are engaged with the side wall upper surfaces and thereby support the front and rear ends of the mobile apparatus thereon, the method including:

(a) moving said mobile apparatus longitudinally along said side wall upper surfaces until reaching the opposite end wall of said railroad car;

(b) raising said front boom structure and lowering said front wheels until engaging said front wheels upon a supportive surface;

(c) disengaging said front boom structure supportive foot member from said side wall upper surfaces;

(d) moving said mobile apparatus forwardly in said railroad car until said front boom structure extends over one end wall of a second railroad car in a train of railroad cars;

(e) lowering said front boom structure supportive foot member into engagement with side wall upper surfaces of said second railroad car;

(f) raising said apparatus front end by pressing downwardly upon said sidewall upper surfaces;

(g) moving said mobile apparatus forwardly along the sidewall upper surfaces of both railroad cars until said outrigger arms supportive foot members reach the one end wall of said railroad car;

(h) folding said rear boom structure and engaging the material engaging device with a car bottom surface longitudinally adjacent the rear end of said mobile apparatus;

(i) unfolding said rear boom structure in engagement with said car bottom surface;

(j) raising said outrigger arms supportive foot members from said side wall upper surfaces;

(k) further unfolding said rear boom structure in engagement with said car bottom surface and moving said mobile apparatus forwardly over said second railroad car;

(l) engaging the outrigger arms supportive foot members with the second car side wall upper surfaces, thereby transferring said mobile apparatus from a first car to a second car in a train thereof.

7. The method set forth in claim 1 including:

(a) moving said mobile apparatus rearwardly along the upper surface of said railroad car until reaching the end thereof;

(b) unfolding said rear boom structure and engaging said material engaging device on the ground surface longitudinally aligned and spaced from said mobile apparatus rear end;

(c) folding said rear boom structure in engagement with the ground surface to move said mobile apparatus rearwardly from the upper surface of said railroad car; and (d) coordinatingly operating said front and rear boom structures and folding said rear boom structure in engagement with the ground surface and raising said front boom structure to lower the mobile apparatus to the ground surface.

8. The method set forth in claim 1 including:

(a) using a grapple as a material engaging device and employing claws thereof for gripping materials.

9. The method set forth in claim 1 wherein:

(a) said front boom structure supportive foot member and said outrigger arms supportive foot members are slidably engaged on said railroad car upper surface to permit longitudinal sliding movement of said apparatus along said railroad car; and including (b) providing a winch on said apparatus front end and operating said winch to slidably pull said apparatus along said railroad car.

10. A method of loading and unloading an open top railroad car comprising:

(a) providing a mobile powered apparatus having front and rear wheels movable over ground surface and including power actuated boom structures pivotally mounted at respective front and rear ends of said mobile apparatus wherein the front boom structure is of a length to reach below the ground surface and above the railroad car side walls and end walls when the mobile apparatus is positioned on the ground and has a free end with a supportive foot member connected thereto which has free ends with lateral movement limiting members extended normally therefrom, and wherein the rear boom structure is articulated and of a combined length to reach the ground when the mobile apparatus is positioned on the upper surfaces of the side walls of the railroad car and said rear boom structure has respective arm lengths with a material engaging device pivotally mounted on a free end thereof and cooperative therewith, and including power actuated, outwardly swingable, outrigger arms connected to the rear end of the apparatus which has respective supportive foot members connected to free ends thereof with lateral movement limiting members extended therefrom;

(b) moving said mobile apparatus over the ground surface and positioning same adjacent one end of an open top railroad car;

(c) raising said front boom structure;

(d) engaging the front boom structure foot member with the upper surfaces of the side walls of said railroad car, (e) folding said rear boom structure and said material engaging device;

(f) engaging the material engaging device upon the ground surface at a point longitudinally aligned with and adjacent to the mobile apparatus rear end with said material engaging device folded relative to said rear boom structure free end and toward said mobile apparatus rear end;

(g) coordinatingly operating said front and rear boom structures and unfolding said rear boom in engagement with the ground surface while operating said front boom to press downwardly upon the upper surfaces of the railroad car side walls and thereby raise the mobile apparatus from the ground and above the walls of the railroad car and support said apparatus front end on the railroad car upper surfaces by engagement of the front supportive foot with same;

(h) unfolding said rear boom structure and said material engaging device in engagement with the ground and moving said mobile apparatus forwardly toward said railroad car and over the adjacent end wall thereof with said rear wheels forwardly of said end wall;

(i) moving said outrigger arms outwardly of the mobile apparatus rear wheels and downwardly to engage said outrigger arms supportive foot members with the upper surfaces of said side walls and engaging said lateral movement limiting members with said side walls to support said mobile apparatus rear end upon the upper surfaces of the side walls of the railroad car;

(j) repositioning said rear boom structure closer to the end wall of the railroad car;

(k) engaging the material engaging device upon the ground surface;

(l) unfolding the rear boom structure in engagement with the ground surface and moving said mobile apparatus along the side wall upper surfaces of said railroad car;

(m) repositioning said rear boom structure within the railroad car and engaging a bottom interior surface of said railroad car with said material engaging device;

(n) unfolding the rear boom structure in engagement with the bottom interior surface and moving said mobile apparatus along the length of said railroad car; and (o) operating the articulated rear boom structure and material engaging device to engage and discharge material contained within said railroad car and swing said rear boom to one side of the railroad and engage and discharge materials on the ground surface alongside said railroad car.

11. A method of loading and unloading an open top railroad car having spaced, parallel side walls with an upper surface and opposite side surfaces comprising:

(a) providing a mobile powered apparatus having front and rear wheels movable over ground surface and including power actuated boom structures pivotally mounted at respective front and rear ends of said mobile apparatus wherein the front boom structure is of a length to reach below the ground surface and above the railroad car upper surface when the mobile apparatus is positioned on the ground and has a free end with a supportive foot member connected thereto of a length to extend across said car and having surfaces engageable with said side wall upper surface and including lateral movement limiting arm members extending therefrom and engageable with side surfaces of the side walls and wherein the rear boom structure is articulated and of a combined length to reach the ground when said mobile apparatus is positioned on said car upper surface and said rear boom structure has respective arm lengths with a material engaging device pivotally mounted on a free end thereof and cooperative therewith, and a rear end of the mobile apparatus including outwardly swingable power actuated outrigger arms with respective supportive foot members connected thereto;

(b) moving said mobile apparatus over the ground surface and positioning same adjacent one end of an open top railroad car;

(c) raising said front boom structure;

(d) engaging the front boom structure foot member with the upper surface and positioning said lateral movement limiting arm members adjacent the opposite side surfaces of said railroad car;

(e) folding said rear boom structure;

(f) engaging said material engaging device upon the ground surface longitudinally aligned with and adjacent the apparatus rear end;

(g) coordinatingly operating said front and rear boom structures and unfolding said rear boom structures in engagement with said front boom structure and said front supportive foot upon the railroad car upper surface to raise the mobile apparatus from the ground surface and above the upper surface of said railroad car and support said apparatus front end on the railroad car upper surface by engagement of said front supportive foot with same;

(h) further unfolding said rear boom structure in engagement with the ground surface and moving said mobile apparatus forwardly toward said railroad car and supporting said apparatus rear end on the upper surface thereof by engaging the outrigger arms supportive foot members on the railroad car upper surface;

(i) moving said mobile apparatus along the upper surface of said railroad car; and (j) operating said articulated rear boom structure and material engaging device to engage and disengage material relative to said railroad car and swing said material to the ground surface alongside said railroad car.

12. The method set forth in claim 11 wherein:

(a) said front boom structure supportive foot member and said outrigger arms supportive foot members are slidably engaged on said railroad car upper surface to permit longitudinal sliding movement of said apparatus along said railroad car; and including (b) providing a winch on said apparatus front end and operating said winch to slidably pull said apparatus slong said railroad car.

* * * * *